US006685227B2

(12) United States Patent
Merry et al.

(10) Patent No.: US 6,685,227 B2
(45) Date of Patent: Feb. 3, 2004

(54) LABEL, A LABEL SYSTEM AND METHOD

(75) Inventors: Alan F. Merry, Glendowie (NZ); Daniel J. Matthew, Onehunga (NZ)

(73) Assignee: Safer Sleep Limited, Glendowie (NZ)

( * ) Notice: Subject to any disclaimer, the term of this patent is extended or adjusted under 35 U.S.C. 154(b) by 0 days.

(21) Appl. No.: 09/905,250

(22) Filed: Jul. 13, 2001

(65) Prior Publication Data

US 2002/0017784 A1 Feb. 14, 2002

(30) Foreign Application Priority Data

Jul. 14, 2000 (NZ) ..... 505780

(51) Int. Cl.[7] ..... B42D 15/00

(52) U.S. Cl. ..... 283/101; 283/81; 283/900; 40/638

(58) Field of Search ..... 283/79, 80, 81, 283/67, 70, 56, 900; 40/638

(56) References Cited

U.S. PATENT DOCUMENTS 4,128,954 A 12/1978 White ..... 40/310
4,159,129 A 6/1979 Lockhart ..... 282/27 R
4,204,706 A 5/1980 Blum et al.
4,312,523 A 1/1982 Haines
4,637,635 A * 1/1987 Levine ..... 283/101
4,921,277 A 5/1990 McDonough ..... 283/81
5,048,870 A 9/1991 Mangini et al.
5,090,942 A 2/1992 Traise
5,102,169 A 4/1992 Mayfield ..... 283/115
5,565,785 A * 10/1996 Rodgers et al. ..... 324/601
5,603,409 A * 2/1997 Braverman ..... 206/534
5,692,640 A * 12/1997 Caulfield et al. ..... 221/70
5,752,723 A 5/1998 Robertson
5,782,496 A 7/1998 Casper et al. ..... 283/81
5,958,523 A 9/1999 Bradic
5,958,536 A 9/1999 Gelsinger et al.
6,037,042 A 3/2000 Kato et al.
6,343,428 B1 * 2/2002 Granat et al. ..... 40/638

* cited by examiner

*Primary Examiner*—Willmon Fridie, Jr.
(74) *Attorney, Agent, or Firm*—Darby & Darby

(57) ABSTRACT

The invention relates to an arrangement of pharmaceutical labels in a sheet and to a method of monitoring administration of the pharmaceuticals to a patient using those labels. The labels may include indicia to assist transferral of information and/or to a label including information to assist in the administration by infusion of a pharmaceutical to a patient.

19 Claims, 4 Drawing Sheets

LABEL, A LABEL SYSTEM AND METHOD

TECHNICAL FIELD

Figure 1:
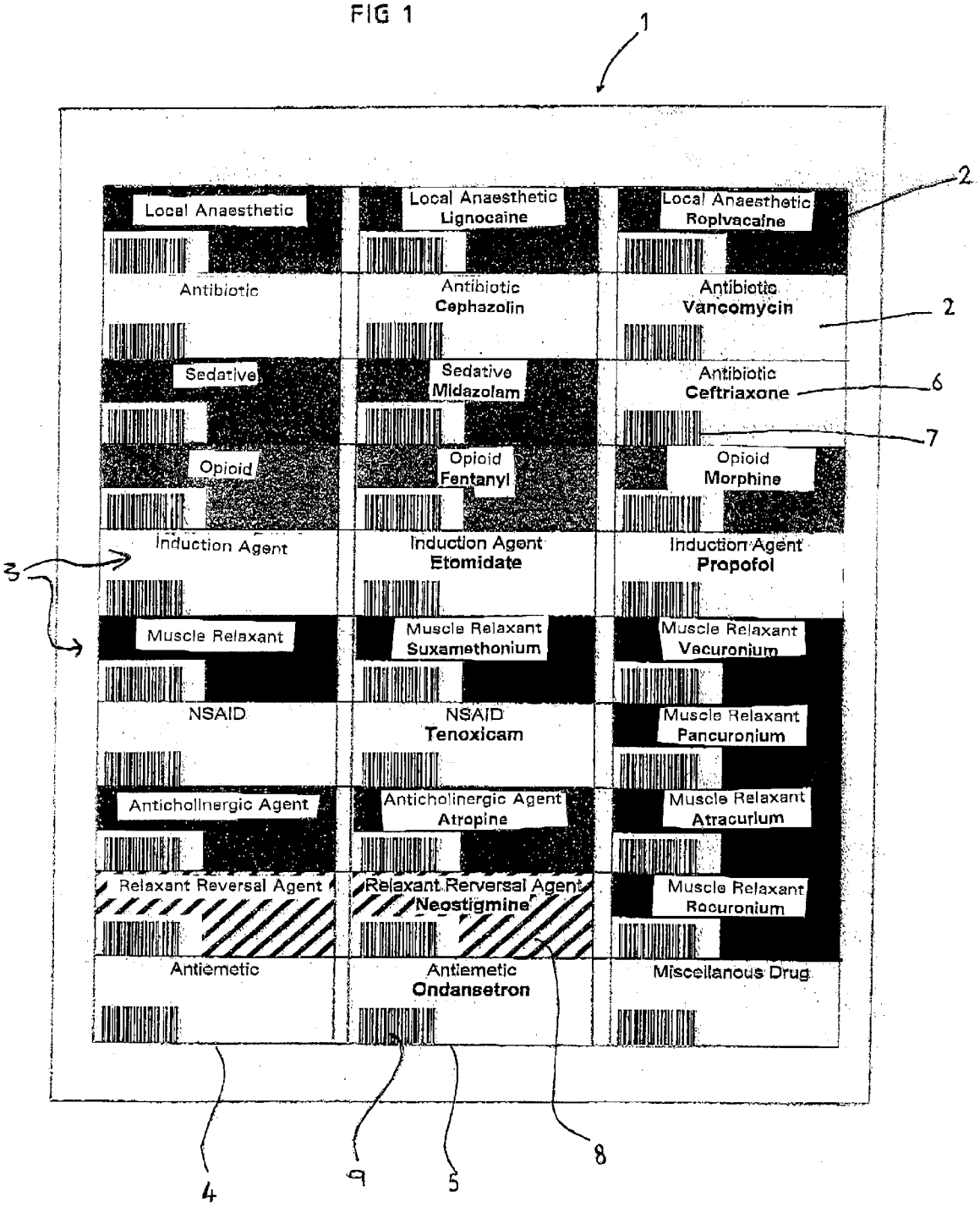

The invention relates to an arrangement of labels, in particular an arrangement of labels on a label sheet, to assist in safe administration of pharmaceuticals to a patient. The invention is also directed to a method of monitoring administration of pharmaceuticals to a patient, using the arrangement of labels provided.

The invention also relates to a label, in particular to a label to assist in the transferral of information and/or to a label including information to assist in the administration by infusion of a pharmaceutical to a patient. The invention is also directed to a container, such as a syringe, including such a label and to a method of pharmaceutical administration using the label.

BACKGROUND ART

The labelling of pharmaceutical containers in order to provide selected doses of pharmaceuticals to patients is known. Difficulties can, however, be experienced when a number of pharmaceuticals have to be administered in a sequence to a patient. Methods and devices to ensure safety in surgical situations particularly surrounding anaesthetic administrations are important.

In operations involving the use of a number of drugs it is generally recommended that labels are used to identify the drugs ("user applied labels"). In such situations it can be difficult to find the label needed, the dispensers often run out of a commonly used label, it can be difficult to quickly establish exactly what drugs have been administered and what drugs still need to be administered. If an error of administration has occurred, it can be difficult to determine or remember exactly what drugs (e.g. anaesthetic drug) have been administered in order to allow a rapid assessment and accurate response.

Another difficulty that can be experienced is that after administration of a series of drugs, it is often time consuming to record the order or range of drugs that have been administered. Complex systems are available but these are not always practical to use. For example, field hospitals would be unlikely to have the ability to use complex recordal systems, particularly not when operating in difficult circumstances.

The usual manner of providing user applied labels for dispensers, such as syringes, is to have a stack of labels (usually in roll form) which are applied to each dispenser as the pharmaceutical is used. However, one difficulty with simply having a bulk storage of labels is that, particularly in operating theatres, there can be limited available space. Typically labels are provided from permanent or semi permanent label dispensers. Typically one dispenser is used for each drug that may be needed. These dispensers take up significant space and can also be a contamination source from one operation to another. Often a dispenser runs out of labels, sometimes in the middle of a procedure, creating difficulties for the user. Typically the containers are not arranged in any particular order.

There is therefore an incentive to provide a means for readily supplying labels that will also assist in improving the safety of drug administration.

In relation to the labels themselves, difficulties can also be experienced in ensuring that the correct drug is administered to the patient. Difficulties can also be experienced in calculating the amount of the drug required to be administered by continuous infusion at a defined rate over time, such difficulties are usually experienced where the pharmaceutical to be administered is a drug which must also take into account the body weight and other characteristics of the patient to whom the drug is administered.

One usual manner of identifying a drug to be used is to write on the syringe, or on a label for the, syringe, the name and amount of drug being, or to be, transferred from a vial containing that drug. This is the usual manner when a drug is to be diluted for infusion over time. As a result it is inevitable that a certain amount of human error will exist and mistakes in administration of those drugs can occur.

When the drug is to be administered by continuous, or intermittent, infusion at a set rate over time, administration devices such as infusion pumps are generally used which are designed to administer a certain volume of solution per unit of time. At present, the method for calculating the appropriate concentration of such a solution to ensure that the correct amount of drug per unit time is administered to a patient of a known weight is a complicated, although known, procedure. Most drugs are presented in containers (ampoules or vials) which contain a known amount of the drug. It is, however, essential that the calculation is correct otherwise difficulties will be experienced.

One method is to use computerised pumps, which calculate appropriate infusion rates on the basis of programmed information such as the patient's weight, the amount of the drug and the volume of diluent. However these pumps are more expensive than standard infusion pumps, and errors can also occur in entering the variables needed to program the pump.

There is therefore an incentive for the provision of means to assist in the correct administration of such drugs.

OBJECT OF THE INVENTION

It is an object of the invention to overcome or ameliorate some of the difficulties associated with the known art or at least to provide the public with a useful choice.

SUMMARY OF THE INVENTION

In a first aspect the present invention provides a pharmaceutical label sheet, the sheet including a pre-selected arrangement of removable user applied labels wherein the sheet, when in use, is capable of assisting in the safe administration of pharmaceuticals.

Preferably, the pharmaceuticals are anaesthetic drugs.

Preferably, each label is colour and/or bar coded.

Preferably, the label sheet is capable of providing a record of pharmaceutical use for a particular procedure.

Preferably, the arrangement of labels is pre-selected based on the medical procedure to be performed and the labels are arranged in order of anticipated pharmaceutical use.

Preferably, the arrangement of labels includes a first column which provides a selection of pharmaceuticals defined by class and at least a second column which provides a selection based on relevant administration criteria.

Preferably, the arrangement of labels includes a column which provides a pre-selected specific pharmaceutical suitable for administration in each class.

Preferably, the arrangement of labels includes a column which provides a secondary pre-selected pharmaceutical suitable for administration in said class.

Preferably, for a given row of labels, the first label defines a class of pharmaceutical, and the second and subsequent labels define specific drugs belonging to that class. Preferably, the labels are adhesively backed and can be removed from a backing sheet.

Preferably, said labels are each adapted in size to be applied to a pharmaceutical administration device.

Preferably, said labels are each adapted in size to be applied to a syringe.

In a further embodiment the present invention provides a method of monitoring administration of pharmaceuticals to a patient, including the steps of:

(a) selecting a sheet of pharmaceutical labels as defined above;

(b) selecting a label from the label sheet that corresponds to the pharmaceutical to be administered;

(c) applying the label to the administration device;

(d) administering the pharmaceutical, and repeating at least steps (b) to (d) as necessary until the required administration of pharmaceuticals to the patient is complete.

Preferably, the label sheet includes a backing layer and the method involves the step of removing a label from the backing layer.

Preferably, the details of the label are repeated on the backing layer, and are discernible after the label has been removed.

Preferably, the administration device is a syringe.

Preferably, the label includes a bar code that corresponds to pharmaceutical label and the method includes the step of scanning the bar code prior to, during or after administration of the pharmaceutical.

Preferably, administration of the pharmaceutical is recorded electronically and/or results in an oral confirmation of the pharmaceutical administered.

Preferably, the step of tracking the administration of one or more pharmaceuticals includes a visual determination of label use from said arrangement of labels.

Preferably, the step of tracking the administration of one or more pharmaceuticals includes the step of analysing data scanned from each bar code of each label, wherein said data is stored on a database.

In a second aspect the invention provides a label including weight based graduations thereon, the graduations being indicative of a volume of diluent which needs to be added to a known amount of a specific pharmaceutical, to produce the appropriate concentration for the pharmaceutical to be administered by continuous infusion, from a container of known dimensions.

In a further embodiment the invention provides an anaesthetic drug label, the label including weight based graduations and indicia specific to an anaesthetic drug, the weight based graduations being capable of accurately representing the dilution required for a specific amount of anaesthetic drug, for a specific infusion rate from an infusion container of specific dimensions.

In a further embodiment the invention provides a container including graduations thereon, the graduations being weight based and being indicative of the dilution required for a known amount of a specific pharmaceutical to be administered by infusion at a known rate from that container.

Preferably, the container is a syringe.

Preferably, the graduations are integral with the syringe.

Preferably, the graduations are applied to the syringe by way of a label.

Preferably, the graduations reflect a non-linear scale.

Preferably, the drug is an inotrope or vasodilator used in anaesthesia, intensive care and similar situations.

Preferably, the drug is dopamine, dobutamine, adrenaline, noradrenaline, milrinone, nitroglycerine, nitroprusside, isoprenaline, and the like.

Preferably, the graduations reflect the weight of patients in the preferred weight range of 140 kg to 28 kg and more preferably between 110 kg and 28 kg.

Preferably, one label is used for more than one pharmaceutical.

In a further embodiment the invention provides a method of administration of an drug to a patient by way of infusion, the method including the step of determining the required dilution of a specified amount of the drug, in a syringe of known dimension, by use of a label including dilution graduations based on patient weight.

In broad terms the invention may also be seen to be a kit including a syringe having a graduated weight scale thereon, as described herein, together with a vial containing a known amount of a pharmaceutical.

Preferably, the label is adapted to receive a second label, the second label being adapted to be transferred from a drug container and to indicate the exact content of the drug container.

The invention in a third aspect provides a combination label including a primary label for attachment to a first container, the primary label including adhesive on a first side thereof and a secondary, removable, label attached to the second side thereof, the second side of the primary label also including suitable indicia to identify the content of the first container, the secondary label being adapted to be transferable to a second container and to include suitable indicia to identify the content of the first container once transferred to the second container.

Preferably, the suitable indicia on at least one of the primary or secondary labels includes a bar code.

Preferably, the bar code is adapted to import specific drug information to a computer system resulting in a record of the transferral being kept and, optionally, visual and/or oral confirmation of the drug being transferred.

In a further embodiment, the invention provides a method of accurately labelling a second container into which the contents of a first container are to be transferred, the first container including a combination label according to the third embodiment of the invention; the method including the steps of:

(a) transferring the contents, or part thereof, of the first container to the second container; and (b) transferring the secondary label of the composite label from the first container to the second container.

Preferably, the first container is an ampoule or vial, the second container is a syringe and the contents transferred is an anaesthetic drug.

Further embodiments of the invention will become apparent from the following description and drawings.

DRAWINGS

The invention will now be described with reference to a preferred forms of the invention. In the Figures:

FIG. 1: shows a schematic depiction of a preferred form of a label sheet according to the first aspect of the invention.

Figure 2:
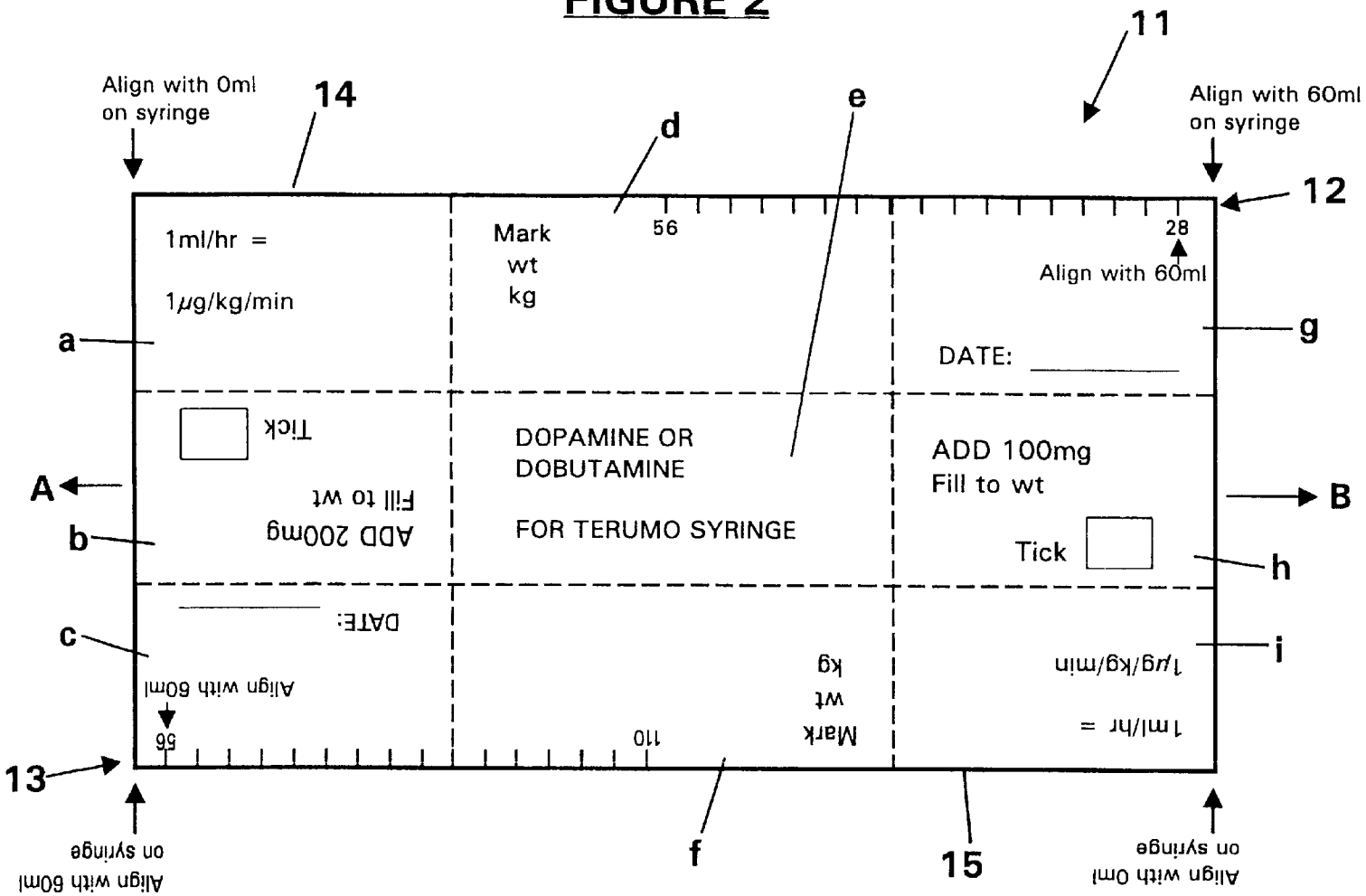
Figure 3:
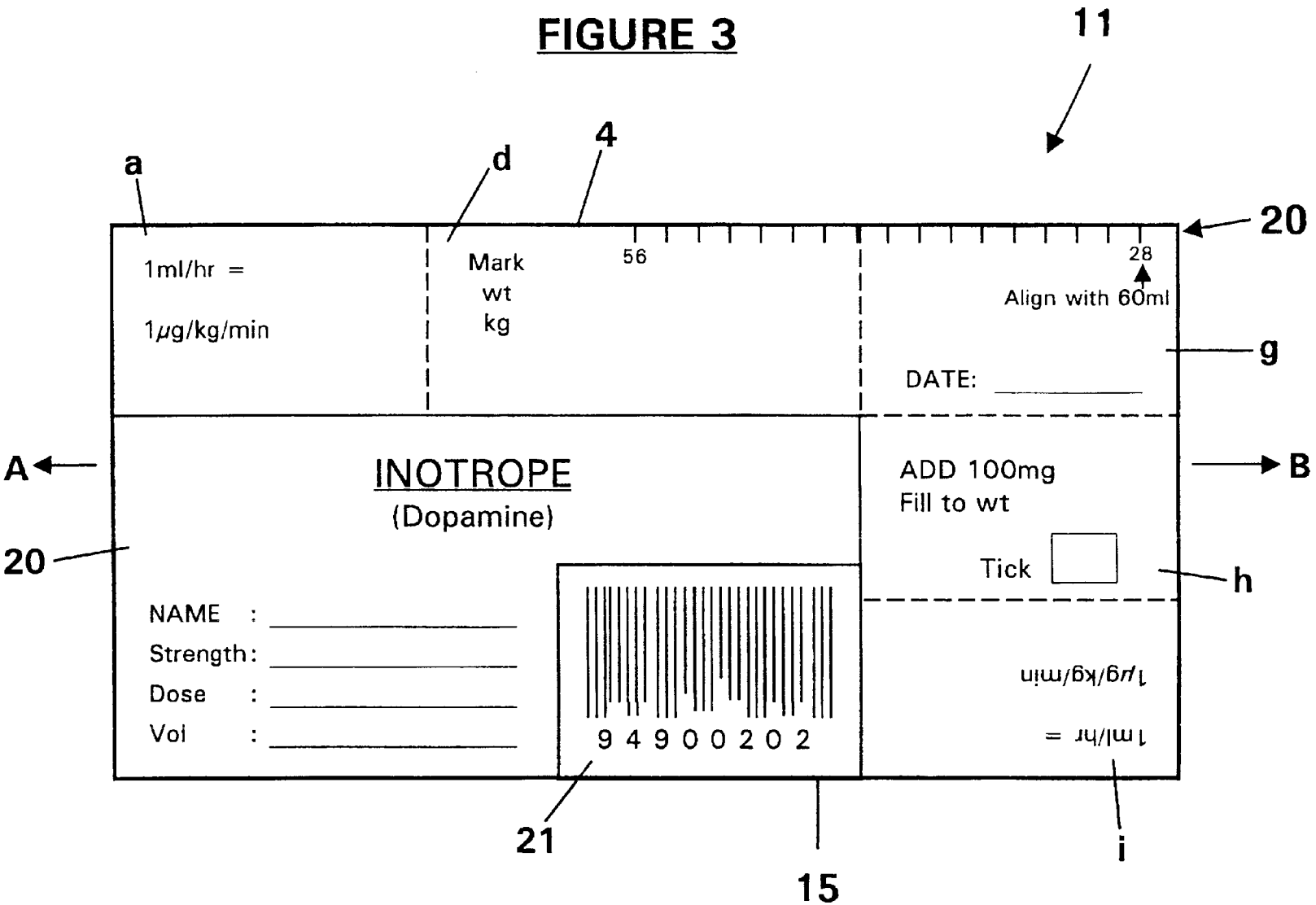
Figure 4:
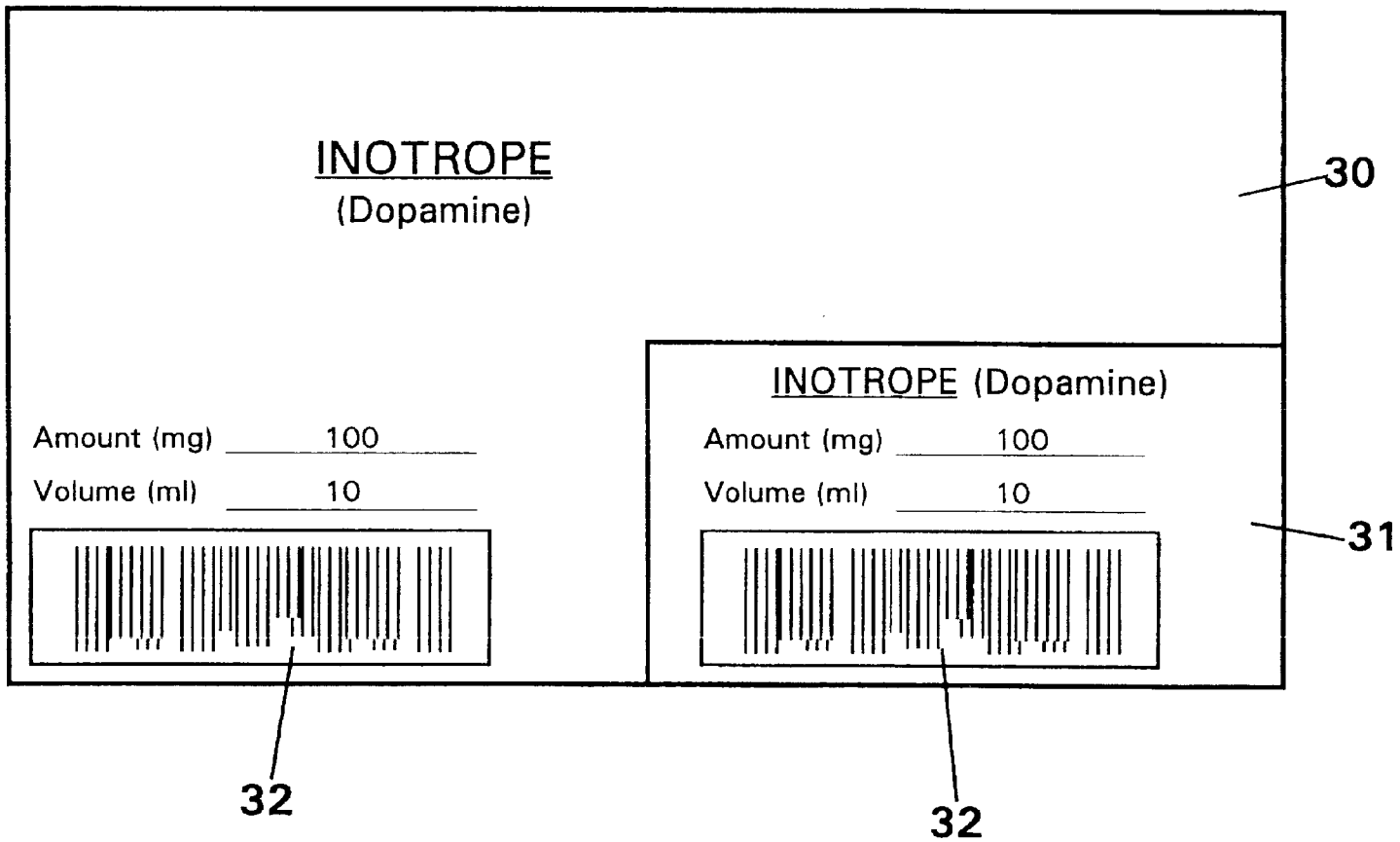

FIG. 2: shows a schematic depiction of a preferred form of a label according to the second aspect of the invention;

FIG. 3: shows the preferred form of the invention as shown in FIG. 2 further including an additional label thereon; and FIG. 4: shows another preferred form of the label according to the second aspect of the invention in schematic form.

DETAILED DESCRIPTION OF THE INVENTION

With reference to FIG. 1 the first aspect of the invention is generally directed to a label sheet 1 including a number of labels 2.

The labels are preferably ordered into classes of pharmaceuticals 3 with the particular, and preferred, embodiment represented in FIG. 1 being pharmaceuticals used in anaesthesia. The classes 3 are typically specified on the label as is shown in FIG. 1.

It is preferred that the first column of labels 4 provides a guide as to the class of anaesthetic of the subsequent labels in each row. This first column will provide a label for generic use if needed. It is preferred that in the second column 5 is the most preferred pharmaceutical for the class selected given the nature of the anaesthetic procedure. The later columns can be based on administration criteria such as alternative pharmaceuticals that could be used, varying concentration of the same pharmaceutical, providing an antagonist for use if needed, and like administration criteria that would be useful to the user.

The specific name of the specified pharmaceutical 6 is also preferably provided on the label. Thus, midazolam is provided as a sedative, fentanyl as an opioid and etomidate as an induction agent. The labels thus show both the class name and the specific name. This is preferred as it provides an additional safety mechanism by which similar sounding or looking names can be distinguished. A characterising bar code 7 can also be optionally included to provide a further level of identification and/or oral confirmation of the pharmaceutical used.

As shown in FIG. 1, the different classes of pharmaceuticals can also be visually identifiable by a colour or pattern 8 on each label. These colours or visual patterns are preferably coded according to relevant New Zealand and Australian standards but this could, of course, vary as needed from country to country.

Preferably each label 2 is of the user applied type and is adhesively backed and is removable from the sheet's backing layer as will be known in the art. The adhesive will preferably be able to adhere the label to either a glass or plastic surface. In a preferred, but not essential, alternative, the portion of the backing layer behind the label 2 could repeat the wording or other indicia contained on the label 2. This wording could be printed on the reverse side of the backing layer and be discernible by the user through the backing layer once the label has been removed. In this way it would be clear what had been used and in what amount. It is also possible that removal of the labels could result in a hole in the sheet with individual labels having individual backing layers to protect the adhesive. In use, during the course of a surgical procedure requiring the use of a sequence of differing anaesthetic drugs, it may also be necessary to have more than one page of labels. Preferably the labels would be arranged in a class order that the user would ordinarily follow during an operation and whether one or two sheets were required should not cause difficulty. It is preferred that a single sheet is used but this may not always be practical.

In use, the labels 2 on the sheet 1 are arranged in the approximate order of anticipated pharmaceutical use such that the likely first choice of an anaesthetist within a class of drugs is specifically catered for with a label in the second column. It is possible that the label sheet may be tailored to a particular user's needs but, ordinarily, the sheets 1 will be relatively standard. Where an anaesthetist might have more than one more choice of particular class, choices are catered for in later columns. There is some variation on the arrangement, particularly in the third row, to allow for the fact that some of the anaesthetists might use a variety of examples of a particular class, but may seldom use a third choice of another class.

The sheet of labels could also act as a prompt for the anaesthetist during the course of surgical procedure. Thus an inspection of unused labels at a point during the anaesthetic will provide a prompt or reminder of classes of drug which are normally given, but which may have been forgotten (e.g. an antibiotic). Alternatively, if the anaesthetist has to administer an opioid for example, the anaesthetist simply has to refer to the label sheet to see a preferred option for an opioid. The anaesthetist then would remove the label and place it on the administration device and/or would scan the bar code 9 associated with the label of the pharmaceutical that will be administered. These steps would be repeated until the anaesthetic procedure was complete. It is envisaged that these labels would primarily be used with syringes but the administration device or other label substrate used in the administration of the drug could vary as will be well known in the art.

If a fast confirmatory check of the drugs administered was needed, a glance at the sheet would indicate quickly what drugs had been administered (i.e. what labels had been used) and hence what response was best suited to the situation. The glance might show for example that no opioid label had been used and thus no opioid had been administered or that an opioid had been administered when one was in fact not needed. If the backing layer behind the label reflects the label's wording, this would assist in this confirmatory checking process In this way, the label sheets provide a record or what has been given over the course of the procedure. The use of bar code scanning of the labels as they are used also provides a further check of the procedure and allows for an electronic record to be kept if desired.

It is also envisaged that the label's bar codes could be programmed to provide individualised computerised responses to the bar codes for particular anaesthetists. Therefore, a generic bar code for sedative could be read as "sedative" for the oral voice responder, but as "sedative, midazolam" for the purposes of making a record for one anaesthetist but as "sedative, diazepam" for another. A second choice of sedative could also be obtained for either anaesthetist by a single keystroke, if desired.

One of the other advantages of the present invention is that the sheet of labels is easy to customise to the requirements of the user. Different users may use different combinations of drugs and sheets could be provided for individual requirements and specific procedures.

The invention is also generally directed to a label which can be applied to a container, or which can be integral with a container. The label will be drug specific (e.g. a named drug) and will be graduated in terms of the weight of typical patients to whom the drug is to be administered.

This label can be used with the label sheet 1 shown in FIG. 1 but need not be.

The container will typically be a syringe but could also be any alternative form of administration device as will be known in the art.

In particular, the invention is intended to be used for the administration of vasoactive drugs where the concentration of the drug to be administered over time varies in terms of the weight of the patient, however, as will be known to a skilled person, there are a variety of drugs that could be administered in this way.

For any specific drug to be given by continuous or intermittent infusion there is a given formula according to which the amount of dilution of the standard amount of drug can be calculated. Such formulae may begin with a stated volume of diluent and then the required amount of drug is calculated; or it may start with a given amount of drug and the required volume of diluent is calculated. The latter approach is often more economic because it permits the entire content of an ampoule or vial of drug to be utilised or a convenient fraction of the content. Some drugs are very expensive so economic issues can be very important. The present invention utilises this latter approach. The label simplifies the calculation by representing the calculated volume of diluent in a visual form and thus ensures that the concentration of the drug for the proposed infusion is accurate. Vasoactive, and similar drugs are often administered as an amount of drug per unit of patient weight per unit time. Therefore, a standard amount of drug would initially be put into the labelled syringe. This will be diluted with a suitable diluent as will be known in the art, such as saline solution or water, to a volume determined by the weight of the patient which is reflected in the label calibration or graduation. The drug will then be administered to the patient at a set rate for that drug. The set rate may be varied, with the object of the process of dilution being to achieve a known and convenient relationship between rate of infusion in units of volume per time and the resultant rate of drug administration as an amount of drug per unit of parts weight per unit of time.

The drugs are usually provided in ampoules or vials or the like ("vials") which contain a standard amount of the drug in a known concentration. The drug contained in the vial is transferred to a syringe and is then diluted for continuous administration over a period of time (i.e. an infusion).

The constant factors for any specific drug are: the syringe dimensions; and the relationship between rates of volume infused per unit time, and rates of amount or mass of drug administered per unit patient weight per unit time. For example, the relationship may be that 1 ml per hour results in the administration of 1 $\mu$g/kg/min; 2 ml per hour results in the administration of 2 $\mu$g/kg/min; 3 ml per hour results in the administration of 3 $\mu$g/kg/min and so on in a linear fashion.

One variable but known factor is the weight of the patient which determines the dilution of the initial amount of the drug. The smaller the patient the greater the drug dilution needed. A second variable, but known, factor is the amount of drug in the vial.

It will be appreciated by a person skilled in this art, that the label, which includes a graduated weight scale, could be transferred from the outside of the vial containing the initial amount of drug, or could be provided as a discrete product to be placed on the outside of the syringe (for example using the label sheet described previously), or could be integrally marked on the syringe.

The label, particularly in its discrete unit form, could also be used in conjunction with a vial labelling system in order to ensure that the drug administered is the correct drug. For example, the vial could include a combination label including a primary label which, in turn, includes a secondary removable label which indicates the name of the drug contained in the vial and its amount and its concentration (together with other relevant information). The secondary label could be added by the user or by the label manufacturer as desired. If added by the user, the primary information supplied by the manufacturer can be retained on the primary label in a visible manner. This secondary label could be transferred from the vial onto the weight graduated label according to the invention, to suitably mark that label, and hence the syringe to be used to administer the drug to the patient, or directly onto the syringe simply to identify the content of the original vial and appropriately and accurately mark the syringe. The remainder of the primary label would remain on the vial to indicate that the vial had been used and the same information which is on the secondary label could be shown or held on the primary label remaining on the vial if desired. The transferable secondary label would preferably include features such as barcoding which could be passed over a sensor connected to a computer system to record that the vial had been used and that the drug contained had been transferred to the syringe. This could be coupled with a method of visual and/or oral confirmation, as a result of the barcode reading, of the drug which had been transferred from the vial to the syringe.

In a simple preferred form of the combination label, the primary label would not include graduations but would be attachable to a vial to indicate the vial content. The primary label would include a removable secondary label adapted to be transferred to a second container, the secondary label also identifying the content of the first container. As will be readily apparent to a skilled person, the primary label will need to include adhesive, or similar, to hold it to the vial and the secondary label may need to include a similar adhesive to releasably attach it to the primary label but which would also allow it to attach to the second container. Of course, there are a variety of other means by which the secondary label could be removably attached to the primary label such as tear off strips or the like which would still allow attachment of the secondary label to the second container. Such alternatives would be readily apparent to a skilled person and need not be exhaustively specified. The use of a barcode to identify the drug is preferred and its use is described later herein.

With reference to FIG. 2, a preferred form of the invention in schematic form is shown. The label 11 is in a discrete form which could be removed from a series of such labels contained on a strip as will be known in the art or contained on a label sheet as described previously herein.

The label 11 contains a series of graduations 12, 13 on opposite sides 14, 15 of the label 11 which divide the label according to units which reflect weight options for a patient. As can be seen in FIG. 2 the label is graduated from 28 kilograms to 110 kilograms and refers to doses using 100 mg and 200 mg of drug. The graduations 12, 13 are shown schematically in linear form but, in practice, those graduations would probably be non-linear. As will be readily apparent to a person skilled in this art the weight scale could be extended or reduced as desired, and different amounts of drug used as appropriate.

The label 11 is adapted to be applied to a syringe with the longitudinal axis of the syringe (not shown) lying along the general lines indicated by arrows "A" and "B", although, as discussed previously, the label could be applied to alternative suitable administration containers as desired. As a result, the weight graduations will begin with the least dilution of the initial drug concentration present in the syringe indicated closest to the needle end of the label.

The label would preferably be applied to a syringe with the needle in either the direction of the arrow "A" or "B" (i.e. the label would be reversed). In such a case the label (as shown in FIG. 2) would clearly indicate different amounts of drug (e.g. 100 mg/200 mg) to be used. The use of a sticker 20 (as discussed further herein in relation to FIG. 3) would convert the label to specify one dose range or the other as desired. In such a case the heavier patient weight, and thus the least dilution needed, would always appear at the end of the label closest to the needle end of the syringe.

As can be seen on the label 11, the graduated scales 12 and 13 are present on opposite sides 14 and 15 of the label 11. The label 11 also includes information about the amount of drug to be used in relation to the respective graduated scales (i.e. 100 mg or 200 mg). The label 11 also contains information pertaining to the specific drug (e.g. dopmine or dobutamine as shown in the label 11 of FIG. 2) to which the label is specifically designed to be used in conjunction with. The label 1 also contains clear reference to the type of syringe (i.e. "Terumo" syringe) onto which the label is to be placed. This information is preferably contained in a central position as is shown on label 11 in FIG. 2.

The size of the syringe to which the label 11 is to be applied may also be specified on the label 11, (e.g. 60 ml etc) although this should be readily apparent to a skilled user from the scales 12, 13.

The label 11, in its preferred form as shown in FIG. 2, will contain nine panels. As seen in FIG. 2, the top left panel "a" and the bottom right panel "i" will contain the same information relating to the relationship between the infusion rate and the corresponding rate of administration of drug amount per unit weight per unit time specific to that drug or drugs indicated in the central panel "e".

Centre left panel "b" and centre right panel "h" contain directions as to the amount of drug which should be present in the initial volume of drug transferred from the vial (not shown) into the syringe (not shown). Panel "b" refers to an initial amount of 200 mg and panel "h" to 100 mg. Panels "b" and "h" also contain instructions to fill the syringe to the weight of the patient and contain a validation box for completion by the user. As shown on label 11 in FIG. 2, this validation simply requires a tick or cross in the box provided but this could also be a request for the initials of the user or similar type indications of validation. The instructions in panel "h" correspond to the graduations 12. The instructions in panel "b" correspond to graduations 13.

Bottom left box "c" and top right box "g" include a portion of the graduated weight scale 12, 13 as well as a request for date information. This information is entirely optional and can be omitted or altered as needed. Also included is a reference to place the final weight graduation (56 kg or 28 kg) at the 60 ml marker on the syringe. The opposite end would be at the 0 ml syringe marker. An appropriate reference may be included if desired.

Top centre panel "d" and bottom centre panel "f" contain a portion of the graduated weight scales (12, 13), a direction to mark the scale and the weight scale criteria (i.e. weight in kilograms).

As has been mentioned previously, the central panel "e" contains reference to the specific drug or drugs for which the label is relevant as well as the specific syringe type which must be used. The syringe size (not shown) could also be mentioned (e.g. "TERUMO 60 ml Syringe").

The label 11 as shown in FIG. 2 reflects that the relationship between infusion rate in units of volume per time as the rate of administration in units of mass per time (as shown in panel "a" and "i") must be known, that the type of drug and the syringe (i.e. dimensions of the syringe) as shown in panel "e" must be constant; and that the initial amount of the specific drug loaded into the syringe from the vial, as shown in panels "b" and "h", must be constant. The variable, the weight of the patient, is reflected in the graduated scales 12 and 13 which are marked on the sides 14 and 15 of the label 11 and thus determines the dilution required for that patient based on that patient's weight and the amount of drug initially used (i.e. 100 mg or 200 mg).

As can be seen from FIG. 2, a graduated weight scale 13 extends from a minimum weight figure in panel "c" which will be furthest to the needle (not shown) in the direction of arrow "B", to a maximum weight situated at a central point on side 15 of the label 11 for the 200 mg drug amount (indicated in panel "b"). The graduated weight scale 12 for the 100 mg amount indicated in panel "h" extends from a maximum patient weight 56 kg (in panel "d") to minimum patient weight 26 kg (in panel "g"). The needle for scale 12 would be in the direction of arrow "A".

As will be readily apparent the weight scale may vary with the type of syringe used and the initial amount of drug used. Similarly, the rate of drug infusion will vary according to the amount of drug to be used. This would be reflected in the specific scale for that drug and drug amount on the label. It would also be possible to incorporate within the scale a second variable such as patient height. In one form this could include markings by height to indicate the maximum weight to be used for a given height to reflect the greater importance of lean body mass than of total body weight. Usually, however, the scale would remain constant. The amount of the drug and the rate of infusion would change for reach agent (i.e. panels a, e and h change or panels i, b, and h). The weight scales would be determined by the syringe dimensions.

With reference to FIG. 3, the label 11 of FIG. 2 is shown with panels "b", "c", "e", and "f" having been covered by a second label, or sticker, 20. The sticker 20 may have been transferred on to the label 11 from a vial (not shown) containing the drug that is to be administered to the patient. It is also possible for sticker 20 to have been sourced from label sheet 1, as shown in FIG. 1, for example. The sticker 20 includes reference to that specific drug (e.g. dopamine, a brand of inotrope as referred to in label 11 in FIG. 2). The sticker 20 may also include indications of the name of the patient and strength, dose, and volume information about the initial drug in the vial. Also preferably contained on the sticker 20 is a barcode 21.

The sticker 20 would be transferred from the vial (not shown) after the contents of that vial had been transferred to the syringe (not shown). The sticker 20 (or the vial including the sticker 20), preferably prior to commencement of the infusion, would be passed over a barcode reader which would read barcode 21 and transfer that information into a computer (not shown) in order to record that this particular drug was being used. In a preferred form, there would be an indication on a computer screen of the drug to which the barcode relates as well as an oral statement via computer speakers. In this way, errors of drug transferral can be minimised. Two basic safety directed concepts are thus considered:

(a) getting the correct label on the syringe (b) checking the drug is the correct drug, and drug amount, intended (at the time of administration).

These safety concepts are directed to the use of bar coding for the graduated label system (FIGS. 2 and 3) and also for the simple primary/secondary label system described previously herein.

As can be seen in FIG. 3, the sticker 20 covers the graduated scale 13 (as shown in FIG. 2) on side 15 of the label 11. This leaves the graduated scale 12 on side 14 of the label 11 exposed. With the sticker 20 in the position as shown in FIG. 3, the label would be for use with a patient having a body weight between 56 kg and 28 kg as is indicated in the graduated scale 12. If the patient had a weight within the range of 56 kg to 110 kg the sticker 10 would have been placed over panels "d", "e", "g", and "h" to cover the graduated scale 2 and to expose graduated scale 13 (as shown in FIG. 2) and a 200 mg initial drug amount should then have been used (in this example). In such a case the label 11 as shown in FIGS. 2 and 3 would be rotated through 180 degrees so that the information shown in an upside down form in FIGS. 2 and 3 would be positioned correctly for reading by the user.

The dimensions of the label would be created so as to conform to the specific size of syringe to which the label was to be applied. In this way the ability to place the label on a syringe of incorrect dimensions would be minimised as this would be immediately apparent to the user. As seen in FIGS. 2 and 3 the minimum weight in the weight scale is intended to be aligned with the 60 ml syringe maker although this could vary as would be readily apparent to a skilled person.

FIG. 4 shows a simple primary/secondary label in schematic and preferred form. The primary label 30 includes secondary label 31 which will be attached in a removable manner as will be known in the art. The primary label 30 and the secondary label 31 includes manufacture's information visually identifying the drug as the Inotrope, dopamine, and the amount of drug and the volume of the vial (not shown). Label 31 also includes identical bar coding 32 which will be adapted to identify the content of the vial. Optionally, this may be included on the ampoule as well.

In use, the contents of the vial will be transferred to a syringe (not shown) and the secondary label 31 will be removed from the primary label 30 and also be attached to the syringe. Optionally the syringe will be passed over a reader (not shown) which will transfer the barcode information into a computer system that will record the exact drug transferred. This will preferably be followed by visual and/or oral (electronic) confirmation of the drug in the syringe (i.e. reading the information on screen or hearing the information recorded).

An alternative is that the syringe and secondary label is passed over the bar code reader for recordal, visual check and/or oral check immediately prior to administration of the drug.

The primary label 30 (including secondary label 31) will preferably be attached to the vial by the pharmaceutical (drug) manufacturer to ensure accuracy of information. Alternatively the labels could be applied to the vial prior to use.

It is preferred that, in the course of any procedure, only one drug transfer and one secondary label transfer occur at any one time. The reasons for this are self apparent as it will lessen the opportunity for confusion.

As will be readily apparent to a skilled person, the label as shown in FIGS. 2, 3 and 4 are preferred forms of the invention only. The graduated weight scale could be integral with the syringe supplied specifically for a stated drug. The syringe could be supplied in conjunction with the drug vial in kit form for example. It will also be readily apparent that the use of the sticker 20, as shown in FIG. 3, is optional, as are the features as shown on the label in FIGS. 2 and 3 which are in addition to the graduated weight scales.

The dual drug amount and multi drug nature of the label shown in FIGS. 2 and 3 is preferred as it allows use of a lesser number of labels for a greater number of drugs. This aspect could be extended to labels using other algorithms or formulae. For example this could involve a formula based on a fixed volume of diluents and variable quantities of drug. Single labels for single drugs and for single drug amounts could, of course, be used but this would result in an unwieldy number of labels which would need to be retained for use.

Finally, the label sheet, the graduated form of the label and the primary/secondary (or combination) label concepts and methods involving their use as have been described herein are preferably used (in combination or individually) in conjunction with the apparatus and method as disclosed in PCT/NZ98/00133 to Safer Sleep Limited. The labels disclosed may also be used in conjunction with the label sheet (i.e. they may be the labels on the sheet) but this is optional.

The invention has been described including preferred forms thereof. Alterations and modifications as will be obvious to a person skilled in the art are intended to be included within the spirit and scope of the invention disclosed. Wherein the foregoing description reference has been made to integers having known equivalents, those equivalents are intended to be incorporated as if individually set forth.

Although the invention has been described by way of reference to a preferred embodiment, it is to be appreciated that modifications or variations could be made to the invention without departing from the scope of the invention as defined in the appended claims.

What we claim is:

1. A pharmaceutical label sheet comprising:

a pre-selected arrangement of removable labels, wherein each of said labels is individually coded, and wherein the arrangement of labels comprises:

a plurality of rows wherein the labels in the rows are related by a class of the pharmaceutical;

a plurality of columns wherein the labels in the columns are related by specific pharmaceuticals belonging to the class of the pharmaceutical; and at least one label comprising a back and a face; and a backing sheet wherein the back of the label is in removably adhesive contact with a portion of the backing sheet and wherein the portion of the backing sheet in adhesive contact with the label comprises indicia similar to the face of the label.

2. The label sheet according to claim 1 wherein the pharmaceuticals are anesthetic drugs.

3. The label sheet according to claim 1 wherein each label is color coded.

4. The label sheet according to claim 1 wherein the labels are arranged in approximate order of at least one of anticipated pharmaceutical use and administration criteria.

5. The label sheet according to claim 1 wherein said labels are each adapted to be applied to a pharmaceutical administration device.

6. The label sheet according to claim 1 wherein the labels are each adapted to be applied to a syringe.

7. A method of monitoring administration of pharmaceuticals to a patient, including the steps of:

(a) selecting a label sheet including a preselected arrangement of removable labels, and a backing sheet, wherein each label comprises:

a back being adhesively backed and, a face having indicia and wherein a portion of the backing sheet beneath each label comprises indicia similar to the face of the label wherein said arrangement comprises:

a plurality of rows wherein the labels in the rows are related by a class of the pharmaceutical; and a plurality of columns wherein the labels in the columns are related by specific pharmaceuticals belonging to the class of the pharmaceutical;

(b) selecting the label from the label sheet wherein the label includes indicia on the face corresponding to the pharmaceutical;

(c) applying the label to a pharmaceutical administration device;

(d) administering the pharmaceutical, and (e) repeating at least steps (b) to (d) until the required administration of pharmaceuticals to the patient is complete.

8. The method according to claim 7 wherein the label is applied to a syringe.

9. The method according to claim 7 wherein the labels include a bar code that corresponds to the pharmaceutical label and the method includes the step of scanning the bar code prior to, during or after the administration of said pharmaceutical.

10. A combination label including:

a backing sheet in removably adhesive contact including:

a first side of a primary and a secondary label, the secondary label being removably attached to the primary label, the primary label for attachment to a first container, the primary label including adhesive on the first side thereof and, on a second side thereof, suitable indicia to identify the content of the first container, and the secondary label including adhesive on the first side thereof and being adapted to be transferable to a second container and to include suitable indicia to identify the content of the first container once the secondary label has been transferred to the second container wherein the primary label and the secondary label are arranged such that the arrangement comprises:

a plurality of rows wherein the labels in the rows are related by a class of the pharmaceutical; and a plurality of columns wherein the labels in the columns are related by specific pharmaceuticals belonging to the class of the pharmaceutical;

and wherein a portion of the backing sheet in adhesive contact with the first side of the primary and the secondary labels includes indicia corresponding to that on the face of the second side of the primary and the secondary labels.

11. The combination label according to claim 10 wherein the suitable indicia on at least one of the primary or secondary labels includes a bar code.

12. A method of accurately labeling a second container into which the contents of a first container are to be transferred, the first container including a combination label according to claim 10 and the method including the steps of:

(a) transferring the contents, or part thereof, of the first container into the second container; and (b) transferring the secondary label of the composite label from the first container to the second container.

13. The method of claim 12 wherein the first container is an ampoule or vial, the second container is a syringe, and on the contents transferred is an anesthetic drug.

14. A pharmaceutical label sheet comprising:

a pre-selected arrangement of removable labels, wherein each of said labels is individually coded, and wherein the arrangement of labels comprises:

a plurality of columns wherein the labels in the columns are related by a class of said pharmaceutical; and a plurality of rows wherein the labels in the rows are related by specific pharmaceuticals belonging to the class of the pharmaceutical;

at least one label comprising a back and a face; and a backing sheet wherein the back of the label is in removably adhesive contact with a portion of the backing sheet and wherein the portion of the backing sheet in adhesive contact with the label comprises indicia similar to the face of the label.

15. The label sheet according to claim 14, wherein the pharmaceuticals are anesthetic drugs.

16. The label sheet according to claim 14, wherein each label is color coded.

17. The label sheet according to claim 14, wherein the labels are arranged in approximate order of at least one of anticipated pharmaceutical use and administration criteria.

18. The label sheet according to claim 14, wherein said labels are each adapted to be applied to a pharmaceutical administration device.

19. The label sheet according to claim 14, wherein the labels are each adapted to be applied to a syringe.

* * * * *

UNITED STATES PATENT AND TRADEMARK OFFICE

CERTIFICATE OF CORRECTION

PATENT NO. : 6,685,227 B2
DATED : February 3, 2004
INVENTOR(S) : Alan F. Merry et al.

It is certified that error appears in the above-identified patent and that said Letters Patent is hereby corrected as shown below:

Title page,
Item [75], delete "Daniel J. Matthew" and substitute -- Daniel J. Mathew --.

Signed and Sealed this

Twenty-ninth Day of June, 2004

JON W. DUDAS
*Acting Director of the United States Patent and Trademark Office*